US011648174B2

(12) United States Patent
Su et al.

(10) Patent No.: US 11,648,174 B2
(45) Date of Patent: May 16, 2023

(54) BACK CLAPPING MACHINE WITH CHEST PERCUSSION FUNCTION

(71) Applicant: ALGER TECHNOLOGY CO., LTD., Taichung (TW)

(72) Inventors: Chien-Chung Su, Taichung (TW); Yu-Min Chang, Taichung (TW)

(73) Assignee: ALGER TECHNOLOGY CO., LTD., Taichung (TW)

( * ) Notice: Subject to any disclaimer, the term of this patent is extended or adjusted under 35 U.S.C. 154(b) by 257 days.

(21) Appl. No.: 17/193,613

(22) Filed: Mar. 5, 2021

(65) Prior Publication Data

US 2021/0275389 A1 Sep. 9, 2021

(30) Foreign Application Priority Data

Mar. 6, 2020 (TW) ..... 109107472

(51) Int. Cl.
*A61H 23/00* (2006.01)
*A61H 23/02* (2006.01)

(52) U.S. Cl.
CPC ..... *A61H 23/006* (2013.01); *A61H 23/0254* (2013.01); *A61H 2201/018* (2013.01); *A61H 2201/1207* (2013.01); *A61H 2201/5064* (2013.01); *A61H 2205/081* (2013.01); *A61H 2205/084* (2013.01)

(58) Field of Classification Search
CPC ..... A61H 23/006; A61H 23/0254; A61H 2201/018; A61H 2201/1207; A61H 2201/5064; A61H 2205/081; A61H 2205/084; A61H 2201/149; A61H 2201/1669
See application file for complete search history.

(56) References Cited

U.S. PATENT DOCUMENTS 5,676,637 A * 10/1997 Lee ..... A61H 21/00 601/51
7,128,722 B2 * 10/2006 Lev ..... A61H 7/001 601/111
8,088,086 B1 * 1/2012 Schmuck ..... A61H 23/0254 601/84
2003/0032901 A1 * 2/2003 Webb ..... A61H 37/00 601/49
2019/0110945 A1 * 4/2019 Kawagoe ..... A61B 5/0057
2020/0046601 A1 * 2/2020 Marton ..... A61H 23/0254

* cited by examiner

*Primary Examiner* — Philip R Wiest
*Assistant Examiner* — Minhua Zhao
(74) *Attorney, Agent, or Firm* — Muncy, Geissler, Olds & Lowe, P.C.

(57) ABSTRACT

A back clapping machine with chest percussion function includes a casing, a movement mechanism, a clap mechanism, and a buffer unit. The casing includes an outer cover, a rear cover, and a housing space therein, in which the movement mechanism is disposed. The clap mechanism is in the housing space and connected with the front lateral side of the movement mechanism. The buffer unit is in the housing space and arranged to elastically abut against the outer cover and the rear cover therebetween. Thus, the present invention automatically carries out back clapping operation and detects the distance for back clapping, also provides a shock buffering effect, thus achieving a back clapping chest percussion operation through a hand alike structure and preventing pressure ulcer.

10 Claims, 13 Drawing Sheets

BACK CLAPPING MACHINE WITH CHEST PERCUSSION FUNCTION

BACKGROUND OF THE INVENTION

1. Field of the Invention

The present invention relates to back clapping machines, and more particularly, to a fix tool for brake clamp maintenance.

2. Description of the Related Art

"Chest percussion" is a common clinical method for loosening the phlegm accumulated in lungs of the patient to discharge, thereby preventing the phlegm from continuous accumulation in the lung or trachea to cause pneumonia or bronchitis.

A conventional "chest percussion" operation is carried out by repeatedly clapping the back of human body by use of a palm, wherein the palm is humped (bowl alike) for gently clapping the back from the lower side upward. An elastic percussion cup is also applicable to be hand held for clapping the back of human body. However, the aforementioned chest percussion operation is manually carried out, which not only is time and manpower consuming, but also difficult to be conducted with proper force control. If the clapping force is insufficient, the chest percussion effect will not be ideal, so that the phlegm will not properly loosened from alveolus or cilium of the lung. If the clapping force is excessively large, the alveolus will collapse, causing a further accumulation of phlegm.

Accordingly, an automatic chest percussion machine is developed in the market for replacing the conventionally manual clapping operation. Such machine electronically drives a clap mechanism to clap the back of a patient. The operation thereof is simply without the need of manpower. However, the conventional automatic chest percussion machine has a fixed clapping travel which is unable to be automatically adjusted based on detection. Also, it does not have buffering function during clapping. Thus, the comfort and utility of such machine is not optimal. An improvement thereof is desirable.

SUMMARY OF THE INVENTION

Based on the wish of improving the aforementioned disadvantages of the conventional automatic chest percussion machine, the applicant files the present invention after multidimensional discussions, experiments, and modifications.

For achieving the aforementioned objectives, a back clapping machine with chest percussion function is provided, comprising:

a casing having an outer cover and a rear cap, the casing having a housing space therein, with a front end of the outer cover having a through hole connected with the housing space, the rear cap disposed on a rear end of the outer cover;

a movement mechanism disposed in the housing space of the outer casing, the movement mechanism having a gear, a first motor, a rack, and an infrared detector; the gear being connected with the first motor to be driven by the first motor for rotating in a forward and backward directions, the rack engaged with the gear to be driven to move forward or backward by the gear, the infrared detector disposed on a front lateral side of the outer casing;

a clap mechanism disposed in the housing space and combined with a front lateral side of the movement mechanism, the clap mechanism having a motor substrate, a second motor, a crank, a transmission rod, and a clap head, the motor substrate connected with the rack of the movement mechanism, the second motor disposed on the motor substrate, the crank connected with the second motor to be driven to reciprocate forward and backward by the second motor, the transmission rod connected with the motor substrate and protruding out of the through hole on the front end of the outer cover of the casing, the clap head disposed on a front end of the transmission rod; and a buffer unit disposed in the housing space of the casing and arranged to elastically contact the outer cover of the casing and the rear cover therebetween.

The back clapping machine with chest percussion function of the present invention is able to automatically detect the distance for backing clapping and adjust the travel of the back clapping operation, so as to provide a clapping motion on the back of human body with a hand alike structure, thereby preventing pressure ulcer and achieve a chest percussion function. Therefore, the utility of the present invention is improved.

Also, the back clapping machine provides a shock buffering effect during chest percussion, so as to improve the comfort during usage thereof.

DETAILED DESCRIPTION OF THE INVENTION

Figure 1:
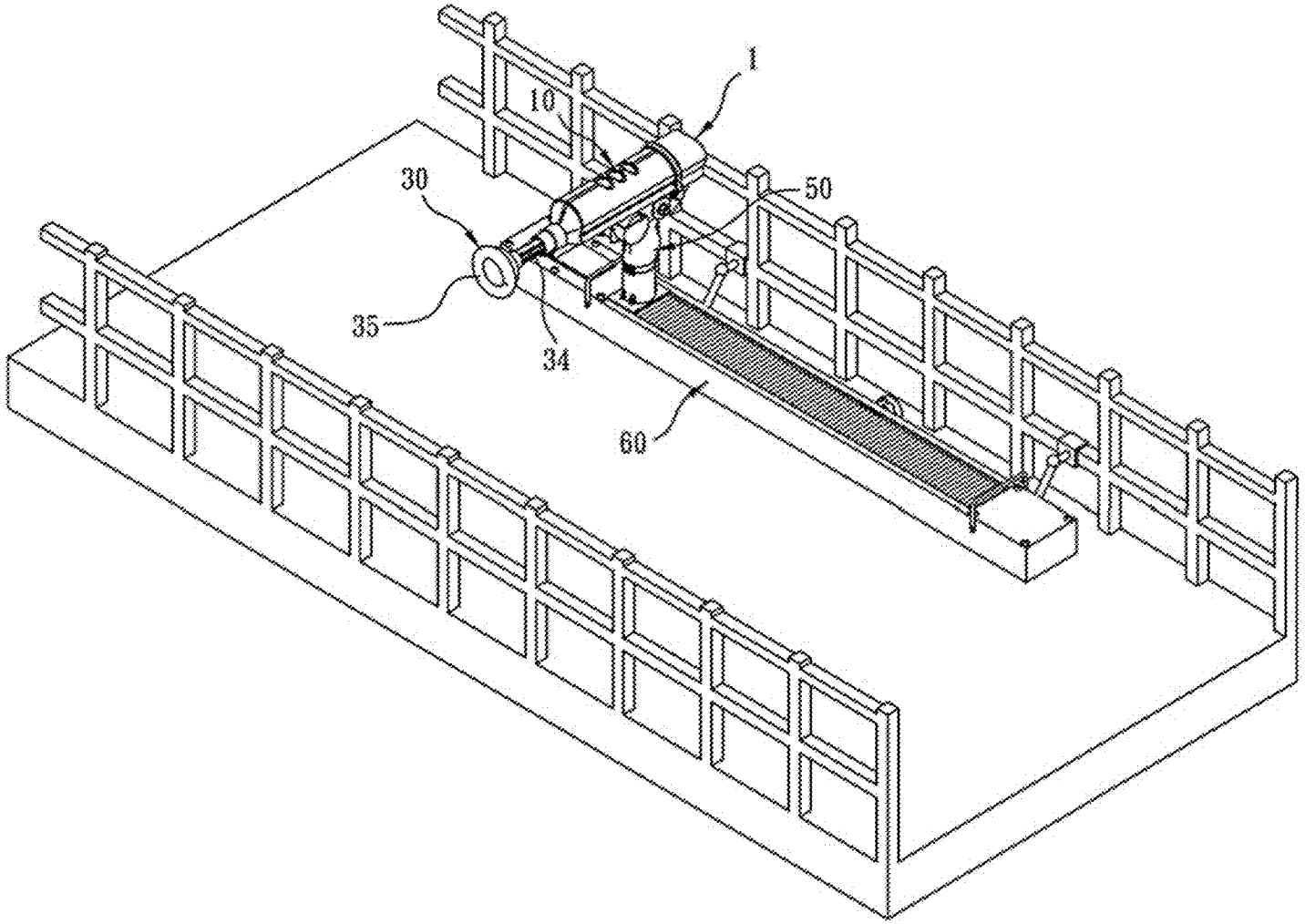
FIG. 1 is a perspective view of the present invention.
Figure 2:
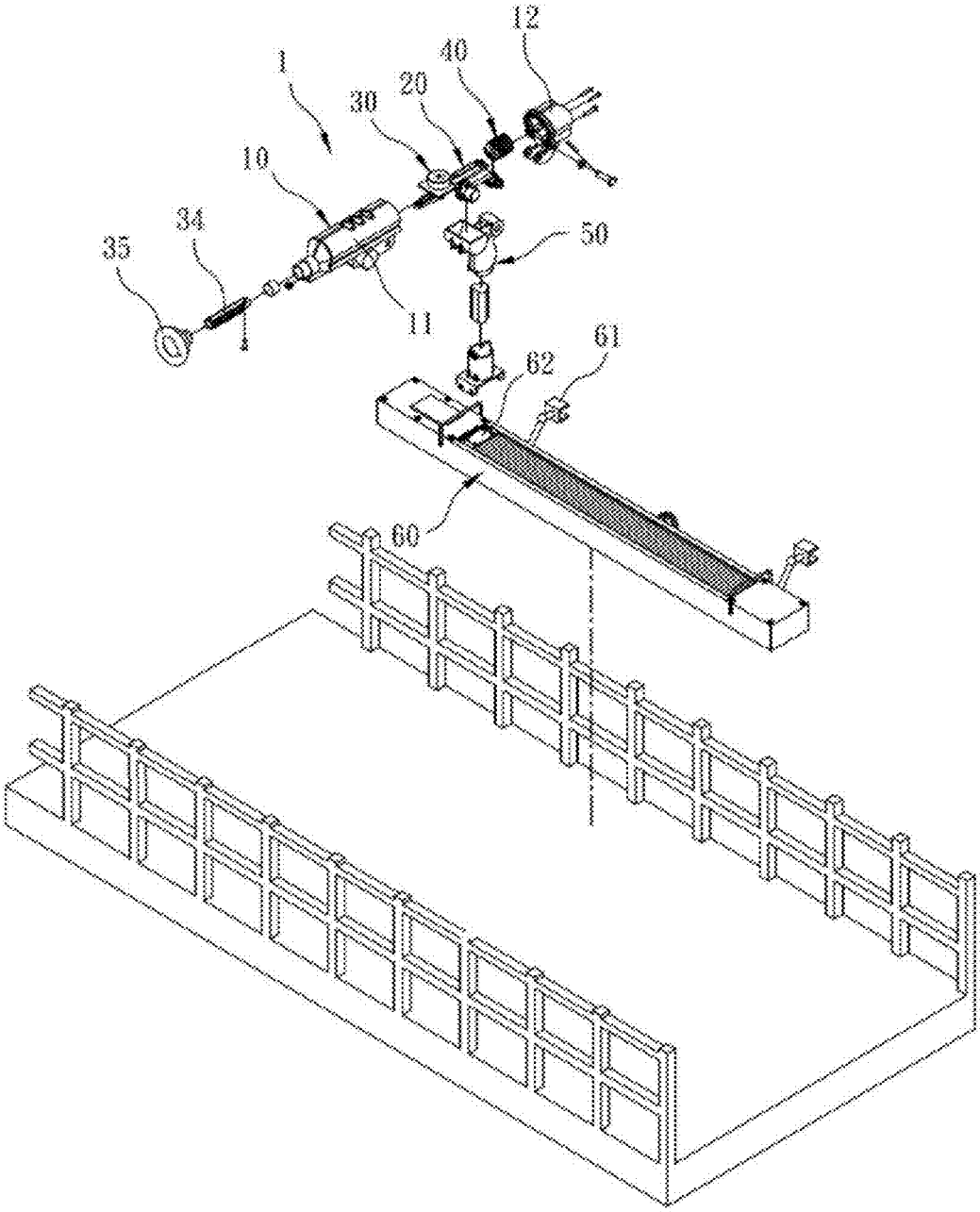
FIG. 2 is an exploded view of the present invention.
Figure 3:
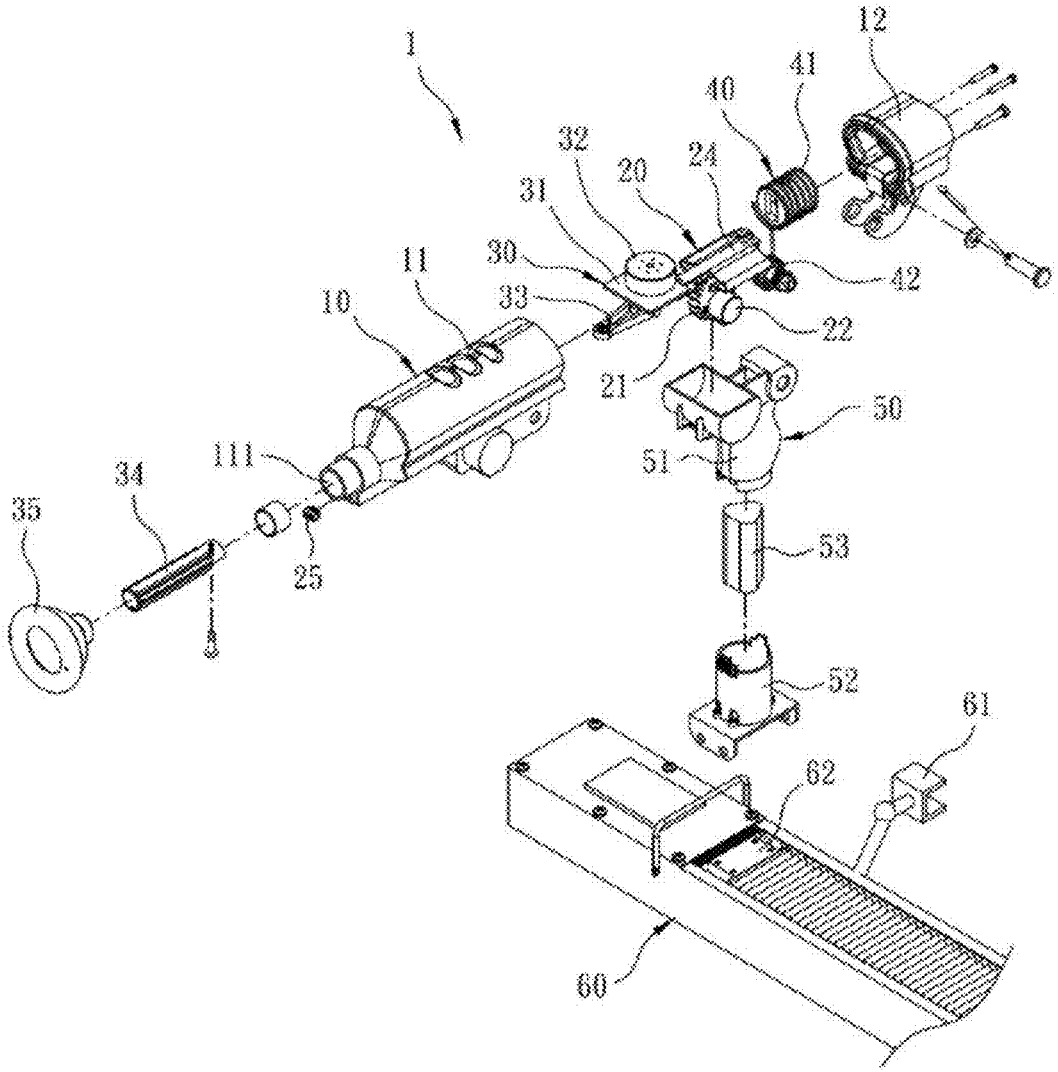
FIG. 3 is a partially exploded perspective view of the present invention.
Figure 4:
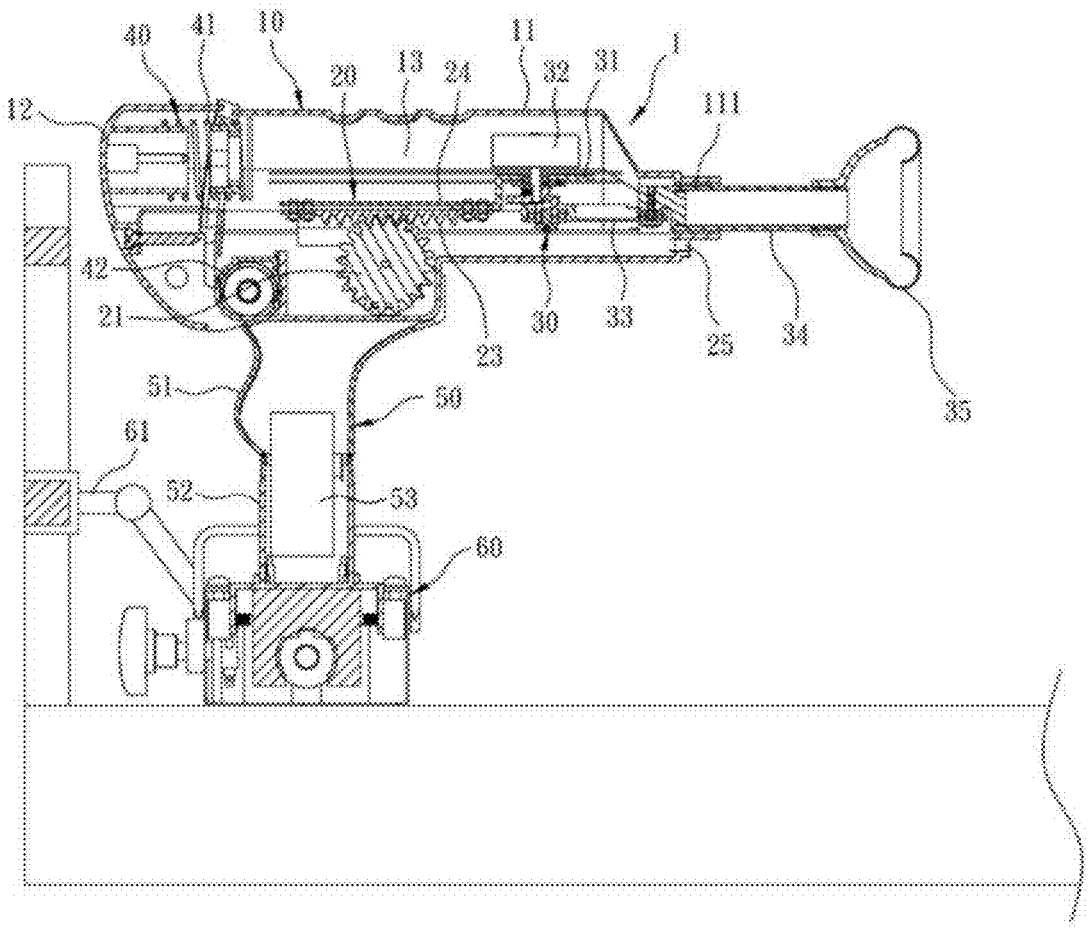
FIG. 4 is a partially sectional view of the present invention.
Figure 5:
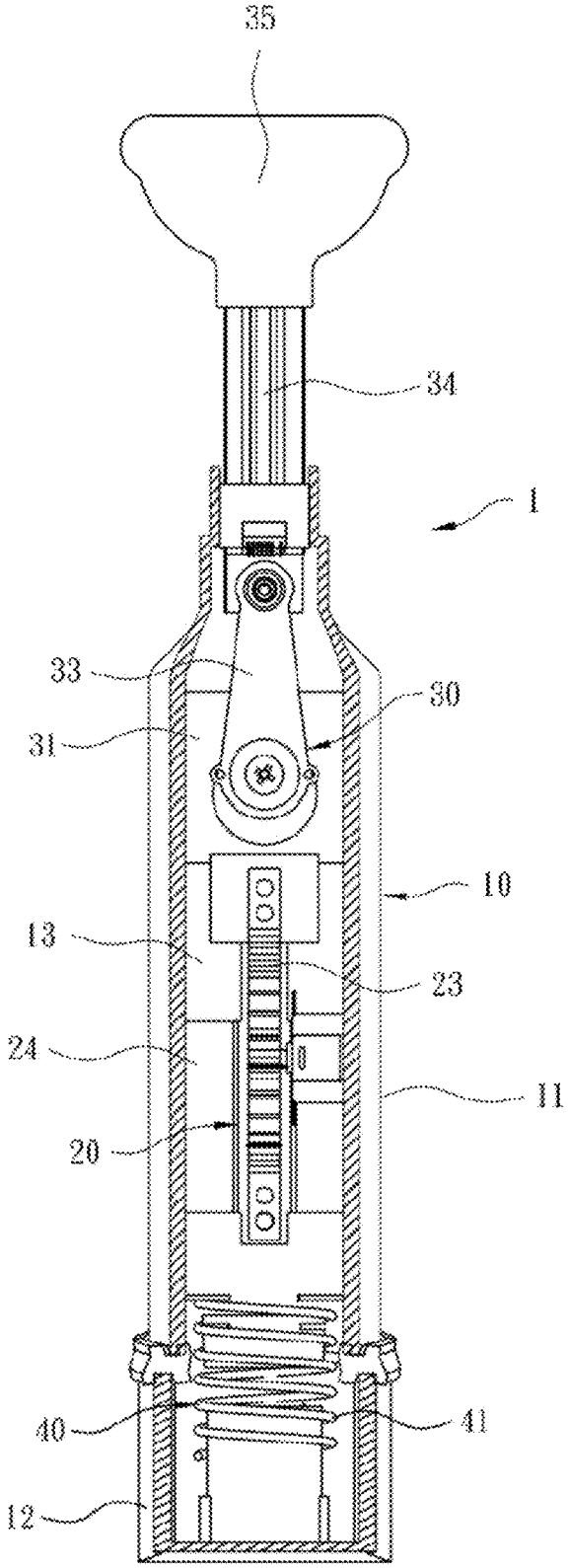
FIG. 5 is another partially sectional view of the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 5, a back clapping machine with chest percussion function is provided by the present invention, comprising a casing 10, a movement mechanism 20, a clap mechanism 30, a buffer unit 40, a support unit 50, and a slide device 60.

The casing 10 comprises an outer cover 11, a rear cap 12, and a housing space 13 therein. A through hole 111 is formed on a front end of the outer cover 11 and connected with the housing space 13. The rear cap 12 is disposed on the rear end of the outer cover 11.

The movement mechanism 20 is disposed in the housing space 13 of the casing 10. The movement mechanism 20 comprises a gear 21, a first motor 22, a rack 23, a positioning slider 24, and an infrared detector 25. The gear 21 is connected with the first motor 22, so that the first motor 22 drives the gear 21 to rotate forward and backward. The rack 23 is engaged with the gear 21, so that the gear 21 rotates forward and backward to drive the rack 23 to move forward or backward. The positioning slider 24 is combined on the rack 23 for restraining the forward and backward linear movement of the rack 23. The infrared detector 25 is mounted on the front lateral side of the outer cover 11 of the casing 10 for detecting the distance for clapping the back of user.

The clap mechanism 30 is disposed in the housing space 13 of the casing 10 and connected with the front lateral side of the movement mechanism 20. The clap mechanism 30 comprises a motor substrate 31, a second motor 32, a crank 33, a transmission rod 34, and a clap head 35. The motor substrate 31 is connected with the front end of the rack 23 of the movement mechanism 20. The second motor 32 is disposed on the motor substrate 31. The crank 33 is connected with the second motor 32 through an eccentric wheel, so that the second motor 32 drives the crank 33 to reciprocate back and forth. The transmission rod 34 is connected with the front end of the motor substrate 31 and protrudes out of the through hole 111 on the front end of the outer cover 11 of the casing 10. The clap head 35 is disposed on the front end of the transmission rod 34.

The buffer unit 40 is disposed in the housing space 13 of the casing 10 and arranged between the outer cover 11 and the rear cap 12 of the casing 10 to elastically contact the outer cover 11 and the rear cap 12. The buffer unit 40 comprises a first buffer member 41 and a second buffer member 42. The first buffer member 41 is a compression spring, and the second buffer member 42 is a torque spring.

The support unit 50 is disposed on the lower side of the casing 10. The support unit 50 comprises a handle 51 and a connection seat 52. The handle 51 is disposed on the lower side of the outer cover 11 of the casing 10. The connections seat 52 is disposed on the lower side of the handle 51. A battery unit 53 is disposed in the handle 51 and the connection seat 52, so as to form a machine body 1 of the back clapping machine.

The slide device 60 comprises two fix units 61 and a slide seat 62. Each fix unit 61 is applied for fastening the machine on a bed frame. The slide seat 62 is applied for combination with the connection seat 52 of the support unit 50, such that the slide seat 62 drives the machine body 1 to slide along the slide device 60.

Figure 6:
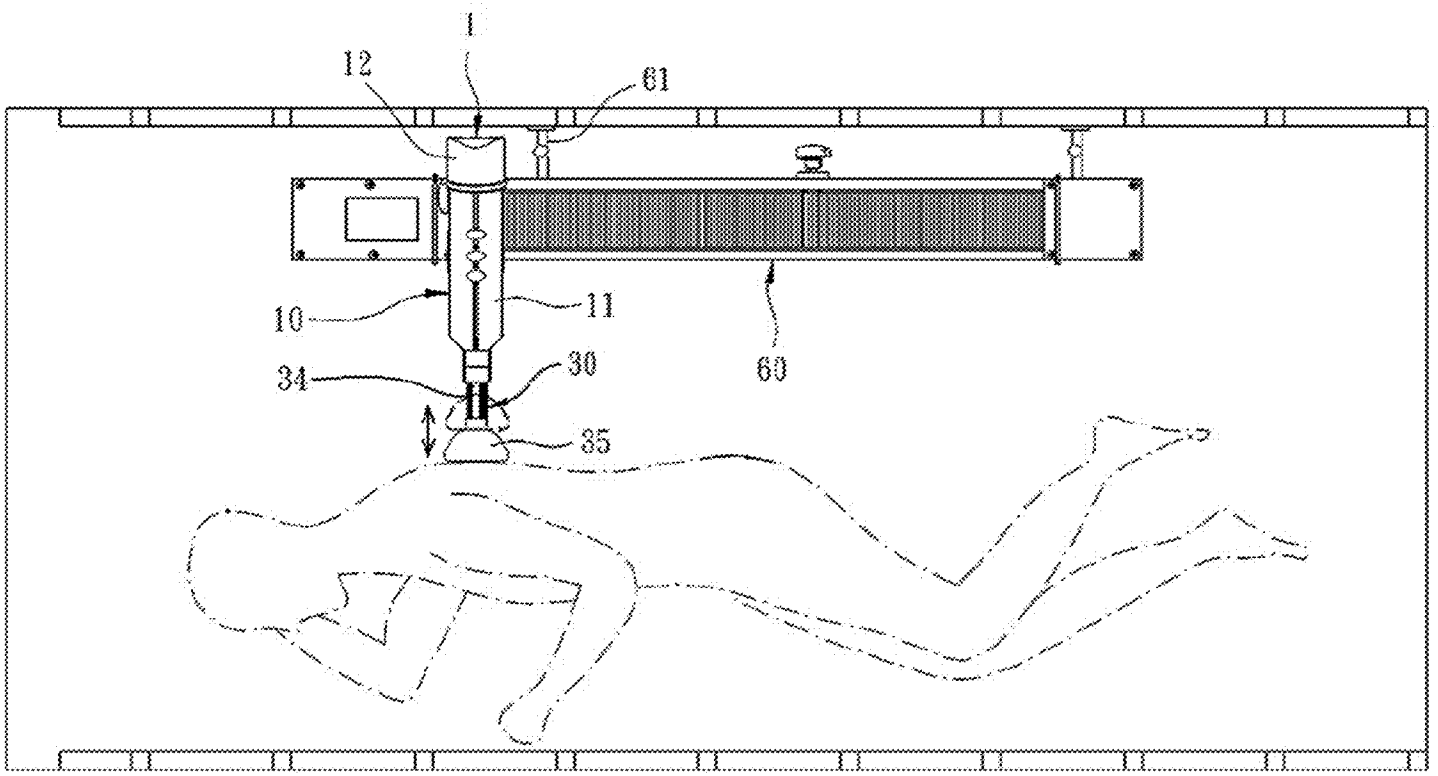
FIG. 6 is a schematic view of the operation status of the present invention.
Figure 7:
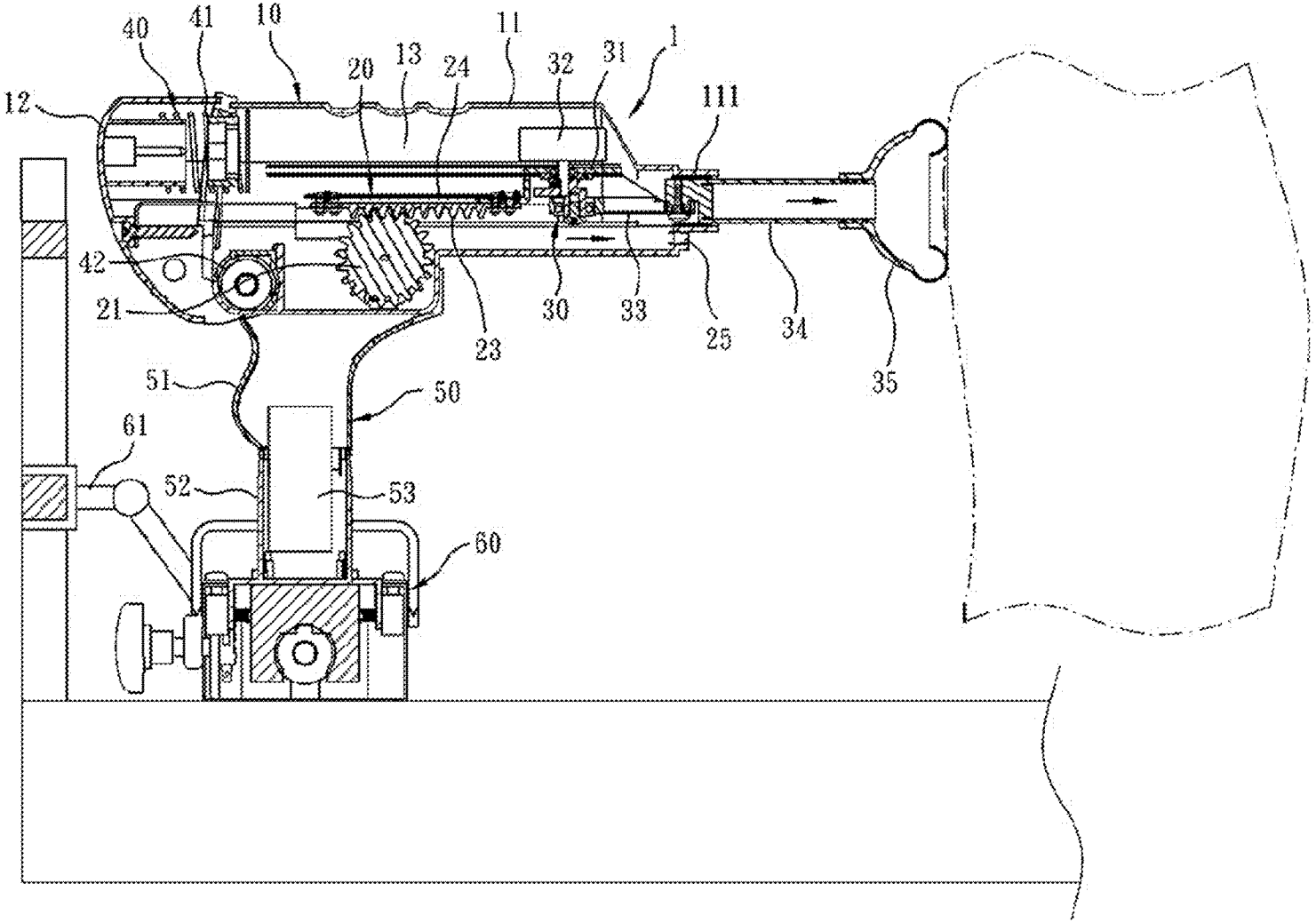
FIG. 7 is a schematic view illustrating the clap mechanism clapping forward.
Figure 8:
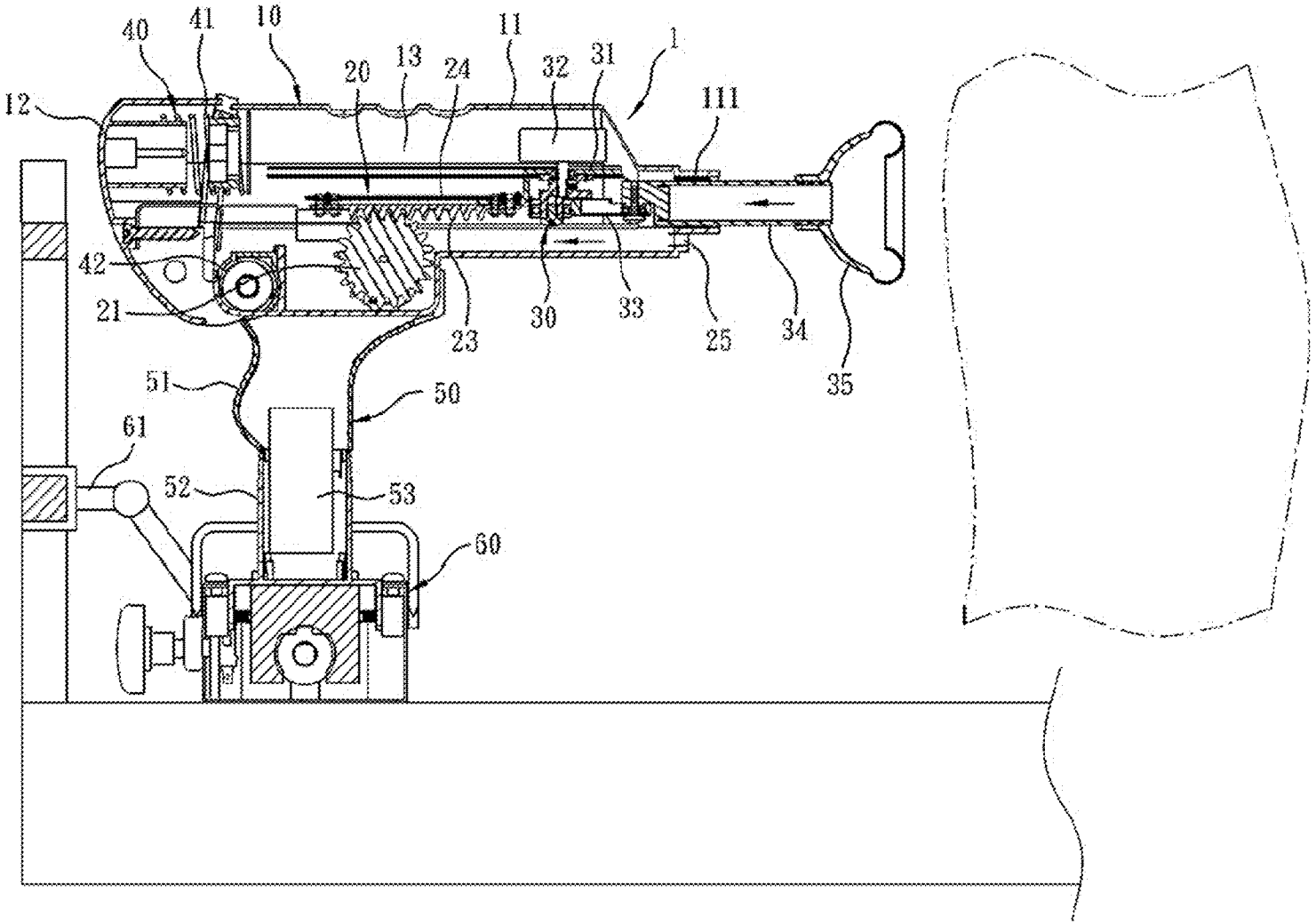
FIG. 8 is a schematic view illustrating the clap mechanism moving backward.

During operation, referring to FIG. 6 to FIG. 8, the second motor 32 of the clap mechanism 30 drives the crank 33 to reciprocate back and forth, and the crank 33 carries the transmission rod 34 and the clap head 35 to repeatedly reciprocate forward and backward, whereby the clap head 35 carries out the clapping motion on the back of user. Also, when the clap head 35 contacts the back of user, a shock buffering effect is achieved through the first buffer member 41 and the second buffer member 42 of the buffer unit 40. Thus, the present invention provides a clapping operation on the back of human with a hand alike structure, thereby preventing pressure ulcer and providing the chest percussion effect.

Figure 9:
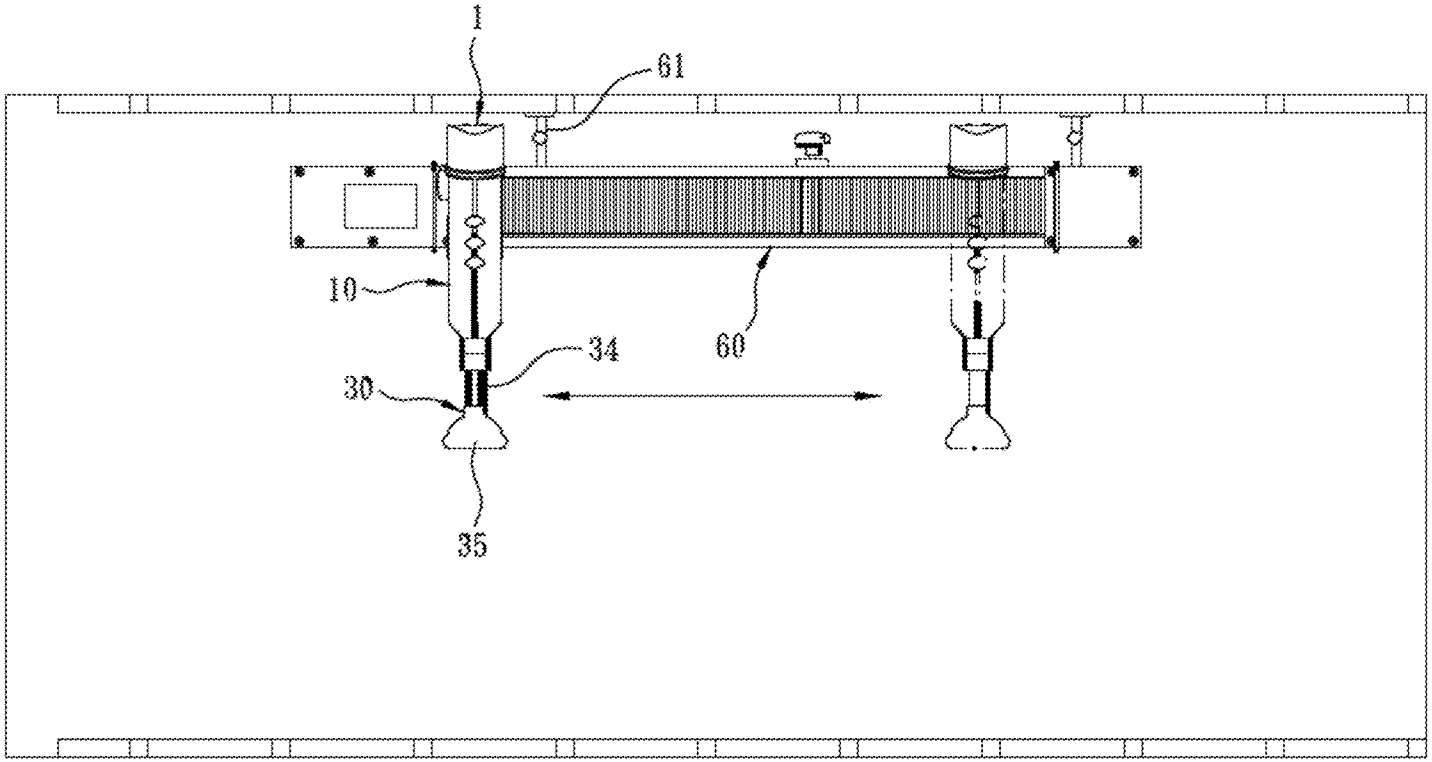
FIG. 9 is a schematic view illustrating the sliding movement of the present invention.
Figure 10:
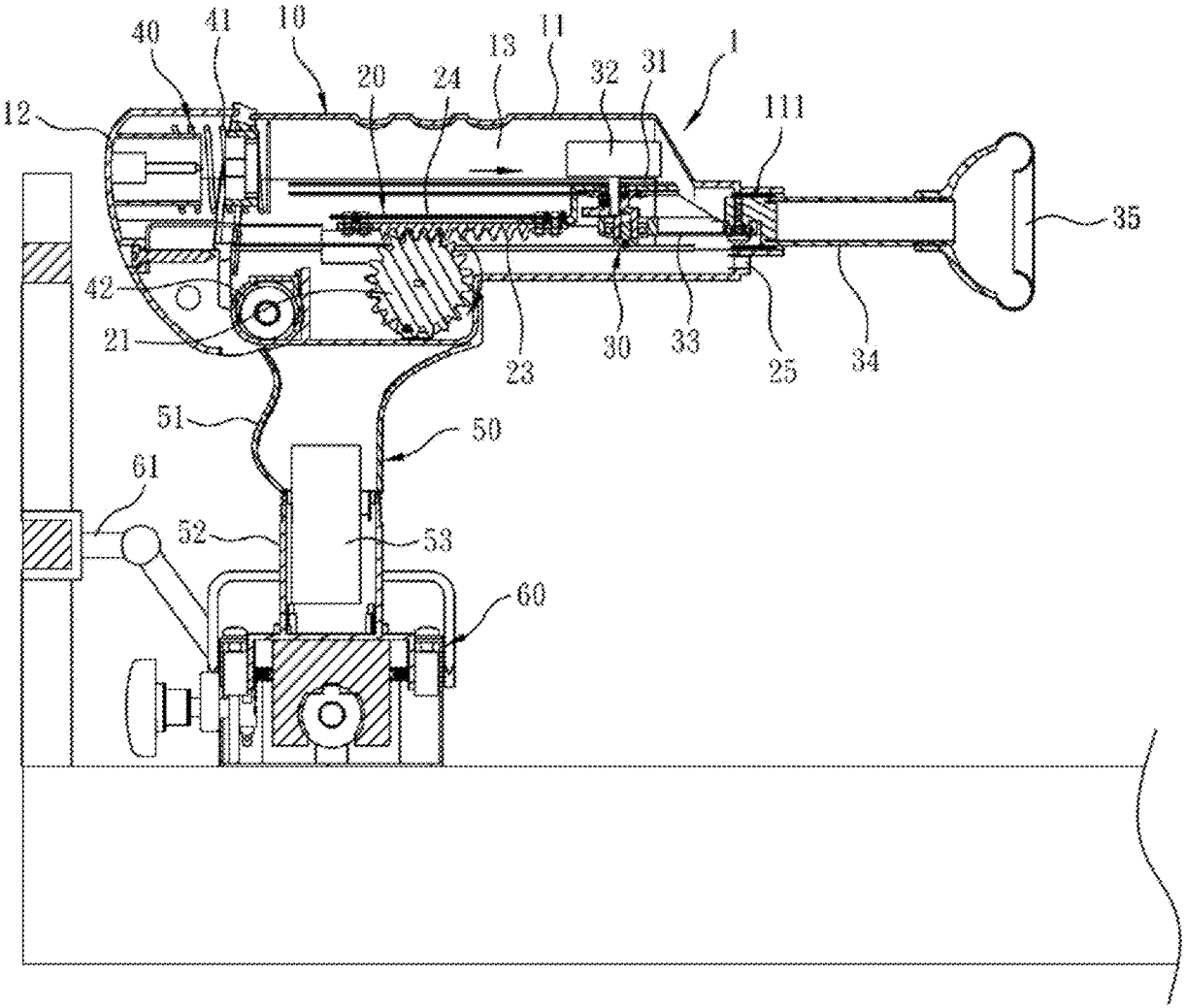
FIG. 10 is a schematic view illustrating the forward adjustment of the back clapping travel of the present invention.
Figure 11:
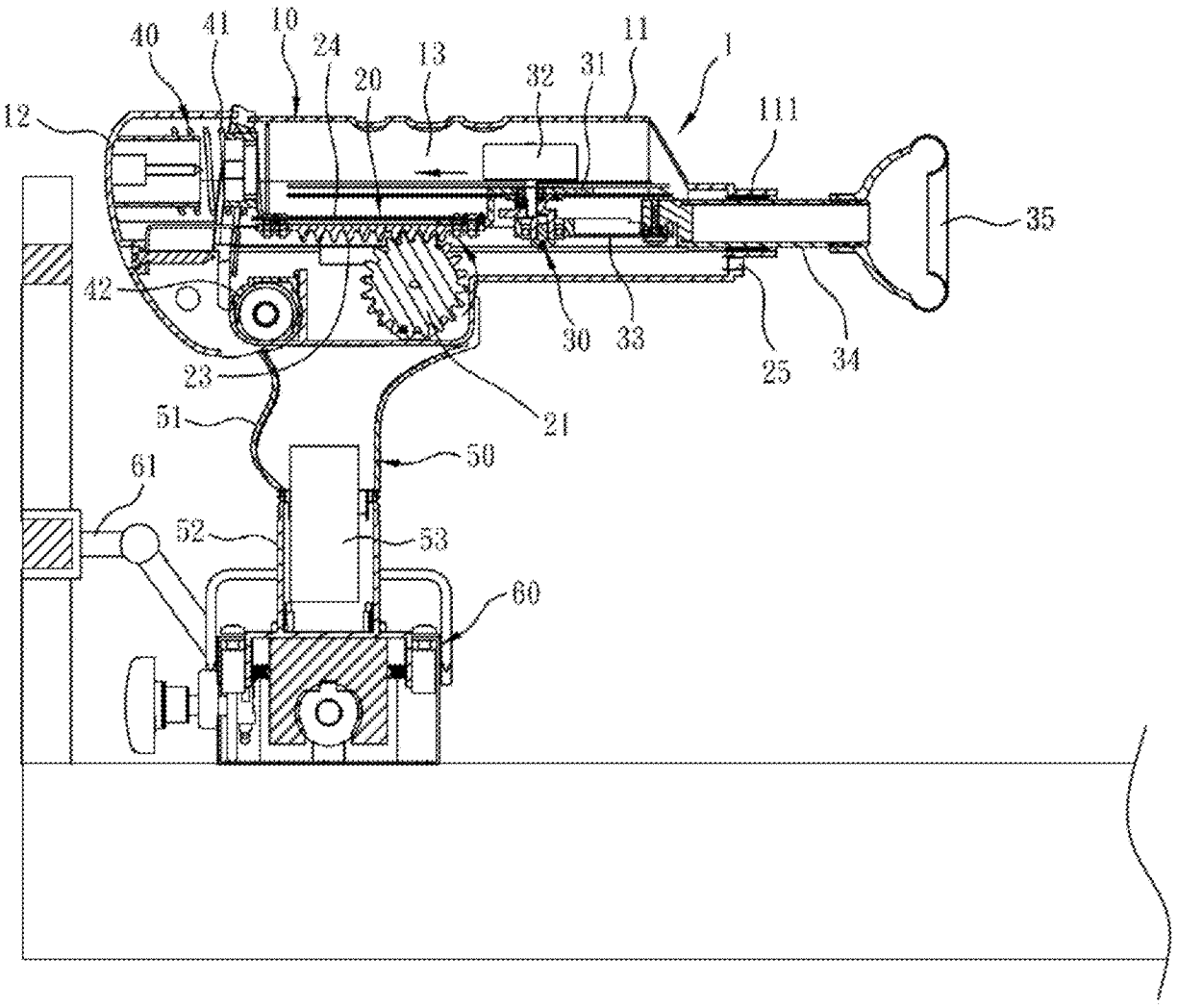
FIG. 11 is a schematic view illustrating the backward adjustment of the back clapping travel of the present invention.

Also, referring to FIG. 9 to FIG. 11, the slide seat 61 drives the machine body 1 to slide along the slide device 60, so as to automatically repeat the clapping motion toward the back of user. Also, during the movement, the infrared detector 25 detects the distance for back clapping the according to the curvature of the back of user, and accordingly controls the first motor 22 of the movement mechanism 20 to drive the gear 21 to rotate forward or backward, whereby the gear 21 rotates forward or backward to drive the rack 23 to move forward or backward. Accordingly, the rack 23 drives the whole clap mechanism 30 to move forward and backward for adjusting the back clapping travel, thereby ensuring that the clap head 35 carries out a proper clapping operation on the back of user. Further, a certain time duration can be set for transmitting information to relevant personnel (such as a nurse, patient family, or caregiver).

Figure 12:
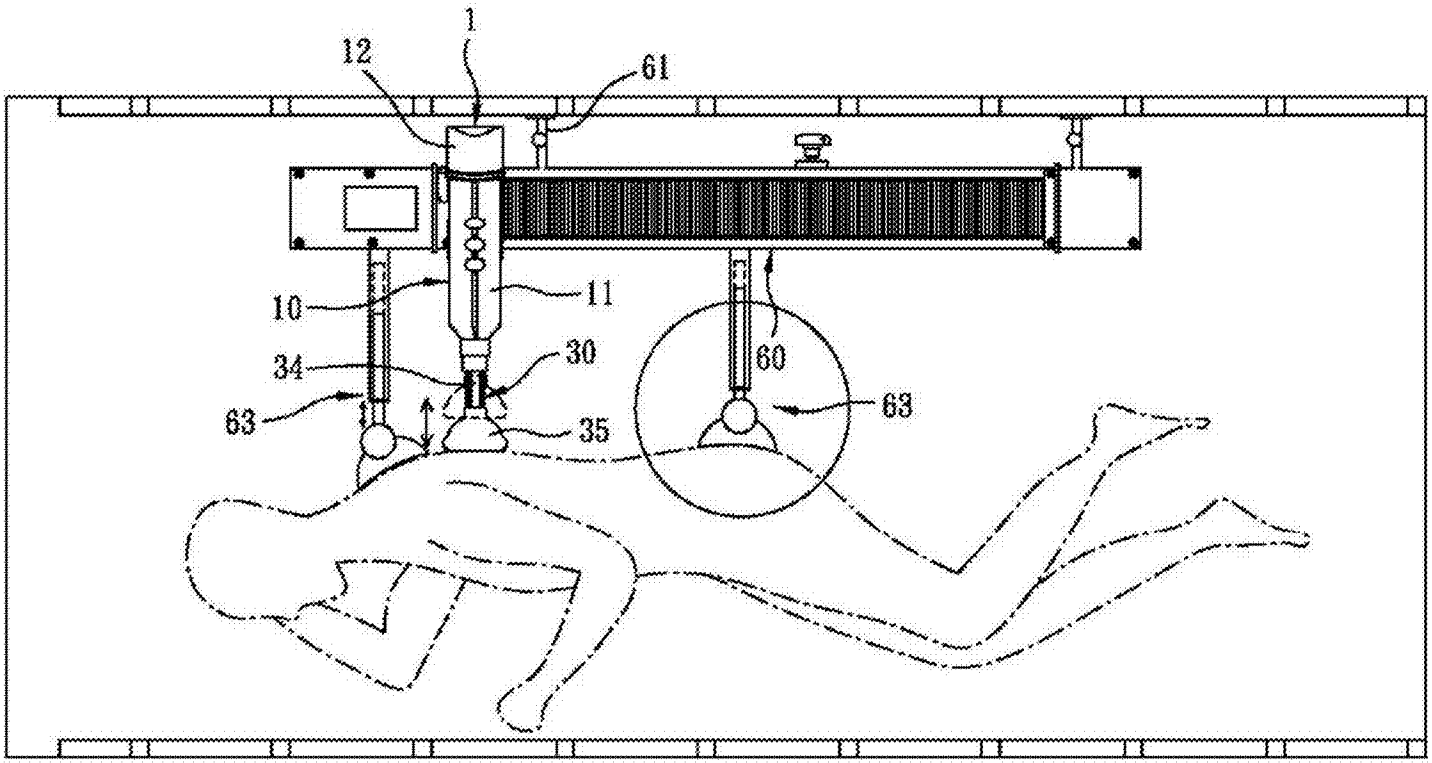
FIG. 12 is a schematic view illustrating the operation status of another embodiment of the present invention.
Figure 13:
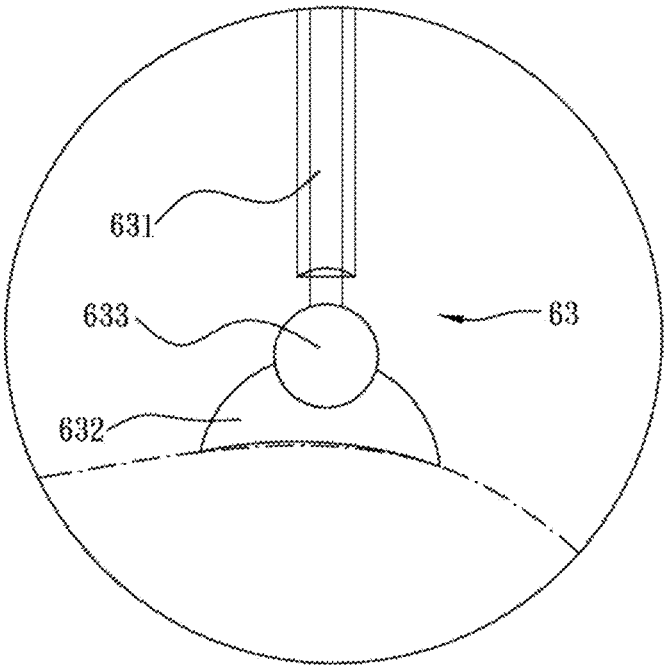
FIG. 13 is a partially enlarged schematic view of FIG. 12.

Referring to the schematic view of the operation of another embodiment, shown by FIG. 12 and FIG. 13, the slide seat 62 of the slide device 60 is provided with two abut units 63 on one side in opposite to the fix units 61. Each of the two abut units 63 comprises a stretch mechanism 631, an abut member 632, and a universal axle 633 disposed between the stretch mechanism 631 and the abut member 632. The two abut units 63 adjust the distance and position of the back and the bottom portion of user through the stretch mechanism 631, and the universal axles 633 are applied for adjusting the angle and allowing the abut members 632 to support the back and the bottom portion of user, so that the user is prevented from biased during laterally lying. Thus, it does not need a caregiver or family to support the back and the bottom portion of the user. The slide seat 61 is able to drive the machine body 1 to slide along the slide device 60, and provide an automatically clapping cycle on the back of user, ensuring a proper clapping operation by the clap head 35.

With the foregoing configuration, advantages of the present invention will be illustrated below.

The back clapping machine with chest percussion comprises a movement mechanism 20 applied for automatically detecting the distance for back clapping and adjusting the travel for back clapping, improving the utility of the present invention.

The back clapping machine with chest percussion comprises a buffer unit 40 for providing a shock buffering effecting, improving the comfort of usage.

The back clapping machine with chest percussion, with the aforementioned movement mechanism 20 and buffer unit 40, is able to adjust the back clapping travel forward or backward and clap the back of user through a hand alike structure, so as to ensure that the clap head 30 provides a proper clapping motion on to the back of human body, thereby preventing pressure ulcer and achieving the chest percussion effect. Also, the present invention can be set to transmit information to relevant receiver (nurse, patient family, or caregiver) with after fixed time duration.

The back clapping machine with chest percussion comprises two abut unit 63 for supporting the back and the bottom portion of human body, preventing the user form biasing when laterally lying. Therefore, it does need a nurse, patient family, or caregiver to provide support for the patient. Also, the slide seat 61 drives the machine body 1 to slide along the slide device 60, so as to provide an automatically clapping cycle on the back of user, ensuring a proper clapping operation by the clap head 35.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A back clapping machine with chest percussion function, comprising:

a casing having an outer cover and a rear cap, the casing having a housing space therein, with a front end of the outer cover having a through hole connected with the housing space, the rear cap disposed on a rear end of the outer cover;

a movement mechanism disposed in the housing space of the outer casing, the movement mechanism having a gear, a first motor, a rack, and an infrared detector; the gear being connected with the first motor to be driven by the first motor for rotating in a forward direction and a backward direction, the rack engaged with the gear to be driven to move forward or backward by the gear, the infrared detector disposed on a front lateral side of the outer casing;

a clap mechanism disposed in the housing space and combined with a front lateral side of the movement mechanism, the clap mechanism having a motor substrate, a second motor, a crank, a transmission rod, and a clap head, the motor substrate connected with the rack of the movement mechanism, the second motor disposed on the motor substrate, the crank connected with the second motor to be driven to reciprocate forward and backward by the second motor, the transmission rod connected with the motor substrate and protruding out of the through hole on the front end of the outer cover of the casing, the clap head disposed on a front end of the transmission rod; and a buffer unit disposed in the housing space of the casing and arranged between the outer cover of the casing and the rear cover to elastically contact the outer cover of the casing and the rear cover.

2. The back clapping machine of claim 1, wherein the movement mechanism comprises a positioning slider combined on the rack for restraining a forward linear movement and a backward linear movement of the rack.

3. The back clapping machine of claim 1, wherein the motor substrate of the clap mechanism is connected with a front end of the rack, and the transmission rod of the clap mechanism is connected with a front end of the motor substrate.

4. The back clapping machine of claim 1, wherein the buffer unit comprises a first buffer member and a second buffer member; the first buffer member is a compression spring, and the second buffer member is a torque spring.

5. The back clapping machine of claim 1, further comprising a support unit disposed on a lower side of the casing; the support unit comprises a handle and a connection seat; the handle is disposed on a lower side of the outer cover of the casing; the connection seat is disposed on a lower side of the handle; and a battery member is disposed in the handle and the connection seat.

6. A back clapping machine with chest percussion function, comprising:

a casing having an outer cover and a rear cap, the casing having a housing space therein, with a front end of the outer cover having a through hole connected with the housing space, the rear cap disposed on a rear end of the outer cover;

a movement mechanism disposed in the housing space of the outer casing, the movement mechanism having a gear, a first motor, a rack, and an infrared detector; the gear being connected with the first motor to be driven by the first motor for rotating in a forward direction and a backward direction, the rack engaged with the gear to be driven to move forward or backward by the gear, the infrared detector disposed on a front lateral side of the outer casing;

a clap mechanism disposed in the housing space and combined with a front lateral side of the movement mechanism, the clap mechanism having a motor substrate, a second motor, a crank, a transmission rod, and a clap head, the motor substrate connected with the rack of the movement mechanism, the second motor disposed on the motor substrate, the crank connected with the second motor to be driven to reciprocate forward and backward by the second motor, the transmission rod connected with the motor substrate and protruding out of the through hole on the front end of the outer cover of the casing, the clap head disposed on a front end of the transmission rod;

a buffer unit disposed in the housing space of the casing and arranged between the outer cover of the casing and the rear cover to elastically contact the outer cover of the casing and the rear cover;

a support unit disposed on a lower side of the casing, the support unit comprising a handle and a connection seat, the handle disposed on a lower side of the outer cover of the casing, the connection seat disposed on a lower side of the handle, a battery member disposed in the handle and the connection seat, so as to form a machine body; and a slide device comprising at least a fix unit and a slide seat, each fix unit applied for being fastening on a bed frame, the slide seat applied for a combination with the connection seat of the support unit, such that the slide seat drives the machine body of the back clapping machine to slide along the slide device.

7. The back clapping machine of claim 6, wherein the movement mechanism comprises a positioning slider combined on the rack for restraining a forward linear movement and a backward linear movement of the rack.

8. The back clapping machine of claim 6, wherein the motor substrate of the clap mechanism is connected with a front end of the rack, and the transmission rod of the clap mechanism is connected with a front end of the motor substrate.

9. The back clapping machine of claim 6, wherein the buffer unit comprises a first buffer member and a second buffer member; the first buffer member is a compression spring, and the second buffer member is a torque spring.

10. The back clapping machine of claim 6, wherein the slide seat of the slide device comprises at least an abut unit on one side in opposite to the at least a fix unit; the at least an abut unit comprises a stretch mechanism, an abut member, and a universal axle disposed between the stretch mechanism and the abut member; the at least an abut unit adjusts a distance and a position of a back and portion and a bottom portion of a human body through the stretch mechanism, and the universal axle is applied for adjusting an angle of the abut member to support the back portion and the bottom portion of user.

* * * * *